US008022300B2

(12) United States Patent
Yamamoto

(10) Patent No.: US 8,022,300 B2
(45) Date of Patent: Sep. 20, 2011

(54) WIRING HARNESS

(75) Inventor: Masataka Yamamoto, Kosai (JP)

(73) Assignee: Yazaki Corporation, Tokyo (JP)

( * ) Notice: Subject to any disclaimer, the term of this patent is extended or adjusted under 35 U.S.C. 154(b) by 199 days.

(21) Appl. No.: 12/457,635

(22) Filed: Jun. 17, 2009

(65) Prior Publication Data

US 2009/0321131 A1 Dec. 31, 2009

(30) Foreign Application Priority Data

Jun. 25, 2008 (JP) ..... 2008-165716

(51) Int. Cl.
*H01B 7/00* (2006.01)

(52) U.S. Cl. ..... 174/72 A; 174/95; 174/101; 174/481; 248/68.1; 439/207

(58) Field of Classification Search ..... 174/72 A, 174/95, 481, 101, 135; 248/49, 68.1; 439/207, 439/404

See application file for complete search history.

(56) References Cited

U.S. PATENT DOCUMENTS 6,268,566 B1 * 7/2001 Takiguchi et al. ..... 174/72 A
6,528,728 B1 * 3/2003 Shima ..... 174/101
6,861,589 B2 * 3/2005 Katsumata et al. ..... 174/68.3
6,972,375 B2 * 12/2005 Sugaya et al. ..... 174/117 F
7,204,704 B2 * 4/2007 Yamamoto ..... 439/174
7,514,630 B2 * 4/2009 Anderson ..... 174/72 A
7,714,228 B2 * 5/2010 O'Brien et al. ..... 174/72 A

FOREIGN PATENT DOCUMENTS

| | | |
|---|---|---|
| JP | 11-039953 | 2/1999 |
| JP | 2002-231064 | 8/2002 |
| JP | 2004-119071 | 4/2004 |
| JP | 2004-165133 | 6/2004 |
| JP | 2004-206992 | 7/2004 |
| JP | 2006-066153 | 3/2006 |
| JP | 2007-200556 | 8/2007 |
| JP | 2008-053200 | 3/2008 |

* cited by examiner

*Primary Examiner* — Dhiru R Patel
(74) *Attorney, Agent, or Firm* — Edwards Angell Palmer & Dodge LLP

(57) ABSTRACT

For connecting a flat cable having a wire interval and a plurality of contact blades having a terminal interval different from the wire interval, a wiring harness includes a flat cable having a plurality of electric wires and joints joining the adjacent electric wires to each other, and a plurality of contact blades arranged along a widthwise direction of the flat cable and connected to a core wire of the electric wire by penetrating an interim portion in a lengthwise direction of the flat cable. A slit is provided at the interim portion at the joint. The plurality of electric wires at the interim portion is positioned corresponding to the contact blade to be electrically connected thereto by being neared to each other by narrowing a width of the slit.

8 Claims, 8 Drawing Sheets

WIRING HARNESS

The priority application Number Japan Patent Application 2008-165716 upon which this patent application is based is hereby incorporated by reference.

BACKGROUND OF THE INVENTION

1. Field of the Invention

This invention relates to a wiring harness, wired in a car, transmitting electric power and signals to electronic equipments.

2. Description of the Related Art

In a car, in which electronic equipments are mounted, there is wired a wiring harness transmitting electric power and signals to the electronic equipments. Such wiring harness includes a connector having electric wires and terminals to connect the electric wires to the other electric wire and/or the electronic equipments.

For the electric wire, a flat cable formed integrally with a plurality of electric wires by joints may be applied. When the electric wire of the flat cable are connected to the other electric wire or the electronic equipment, pressure contact terminals are used (refer Patent Document 1).

FIG. 11 is a cross-sectional view of a flat cable of a wiring harness by prior art in a condition before a contact blade penetrating to the flat cable. FIG. 12 is a cross-sectional view of the flat cable shown in FIG. 11 in a condition of the contact blade penetrating to the flat cable.

The wiring harness 301 shown in FIGS. 11, 12 includes a flat cable 302 having a plurality of electric wires 305 and joints 306 joining the electric wires 305 adjacent to each other, and a plurality of pressure contact terminals 303 arranged at a housing 304 of the electronic equipment.

The electric wire 305 of the flat cable 302 includes an electric conductive core wire 321 and a cover 322 covering the core wire 321. The cover 322 and the joint 306 are formed integrally with insulating synthetic resin. Such flat cable 302 is formed into a band shape so as to be flexible.

The plurality of terminals 303 is formed by pressing a conductive metal sheet so as to have a conductive portion (not shown) to be connected with the electronic equipment and a contact blade 330 projecting from the electronic equipment and penetrating to the flat cable 302 to be joined with the core wire 321. The contact blade 330 includes a pair of blade portions 331 having a gap to position the core wire 321 therebetween, and a blade connecting portion 333 connecting both ends, near to the housing, of the pair of blade portions 331. The plurality of contact blades 330 is arranged along a widthwise direction of the flat cable 302 so as to be controlled not to be changed about an interval P5 of each contact blades 330 along the widthwise direction.

The interval P5 between centers of the adjacent contact blades 330 is adjusted to an interval P6 between centers of the adjacent core wires 321 of the flat cable 302.

As shown in FIG. 11, the center of each core wires 321 of the flat cable 302 is aligned to the center of each contact blades 330 along the widthwise direction of the flat cable at an interim area in a lengthwise direction of the flat cable 302. Thereafter, as shown in FIG. 12, the flat cable 301 and the plurality of contact blades 330 are neared to each other so that the contact blades 330 penetrate to the flat cable 302 so as to touch to the each contact blade 330. Thereby, each of the electric wires and each of the pressure contact terminals 303 are connected electrically to each other. Patent document 1, Japan patent published application No. 2008-53200 should be referred.

SUMMARY OF THE INVENTION

Objects to be Solved

In the wiring harness 302, the interval P6 between the centers of the adjacent core wires 321, that is a wire interval, is ideally designed to correspond to the interval P5 between the centers of the adjacent contact blades 330, that is a terminal interval. The electronic equipment is being miniaturized and the flat cable is being fined about a wire size, so that it becomes difficult to make the wire interval and the terminal interval correspond to each other.

A large pushing force is required to make the contact blade 330 penetrate into the flat cable 302. When the contact blade 330 is miniaturized corresponding to the miniaturized electronic equipment and the fined wire size of the flat cable 302, it is afraid that the contact blades 330 is bent on pushing the contact blade into the flat cable 302, and/or displaced from the electric wire 305.

When the plurality of pressure contact terminals 303 is inserted, the above problems may be occurred.

According to the above problems, an object of the present invention is to provide a wiring harness having a flat cable formed integrally with a plurality of electric wires by joints and a plurality of contact blades connected respectively with the electric wires, and connecting the flat cable and the plurality of contact blades, which a wire interval and a terminal interval are different from each other.

How to Attain the Object of the Present Invention

In order to overcome the above problems and attain the object of the present invention, a wiring harness includes a flat cable having a plurality of electric wires and joints joining the adjacent electric wires, and a plurality of contact blades arranged along a widthwise direction of the flat cable so as to control a terminal interval along the widthwise direction of the flat cable to be maintained, and penetrating to the flat cable at an interim portion in a lengthwise direction of the flat cable so as to touch a core wire of the electric wire, in which wiring harness, a slit is arranged at the joint at the interim portion of the flat cable and the plurality of electric wires is arranged closer to each other by narrowing a width of the slit so as to be positioned corresponding to the contact blade to be electrically connected thereto.

The wiring harness according to the invention is further characterized in that a portion of the contact blade is provided in the slit.

The wiring harness according to the invention is furthermore characterized in that the contact blade includes a top end formed with an acute angle to penetrate the interim portion through the slit.

The wiring harness according to the invention is further characterized in that the adjacent contact blades along the widthwise direction of the flat cable are arranged alternately in the lengthwise direction of the flat cable so as to make an interval between centers of the adjacent contact blades smaller than a width of the contact blade.

Effects of the Invention

According to the present invention, since the slit is arranged at the joint at the interim portion of the flat cable and the plurality of electric wires is arranged closer to each other by narrowing a width of the slit so as to be positioned corresponding to the contact blade to be electrically connected thereto, the wiring harness, in which the flat cable with a wire interval and the contact blade with a terminal interval different from the wire interval can be connected, is provided.

According to the present invention, since the portion of the contact blade is provided in the slit, a large pushing force is not required to make the contact blade penetrate to the flat cable. Thereby, when the miniaturized contact blade penetrates to the flat cable, it can be prevented that the contact blade is bent and/or displaced from the electric wire.

According to the present invention, since the contact blade includes a top end formed with an acute angle to penetrate the interim portion through the slit, the force to make the contact blade penetrate to the flat cable is not required to be large. Thereby, when the miniaturized contact blade penetrates to the flat cable, it can be prevented that the contact blade is bent and/or displaced from the electric wire.

According to the present invention, since the adjacent contact blades along the widthwise direction of the flat cable are arranged alternately in the lengthwise direction of the flat cable so as to make an interval between centers of the adjacent contact blades smaller than a width of the contact blade, the interval between the centers of the adjacent contact blades, that is a terminal interval, can be made smaller.

The above and other objects and features of this invention will become more apparent from the following description taken in conjunction with the accompanying drawings.

DESCRIPTION OF THE PREFERRED EMBODIMENT

Figure 1:
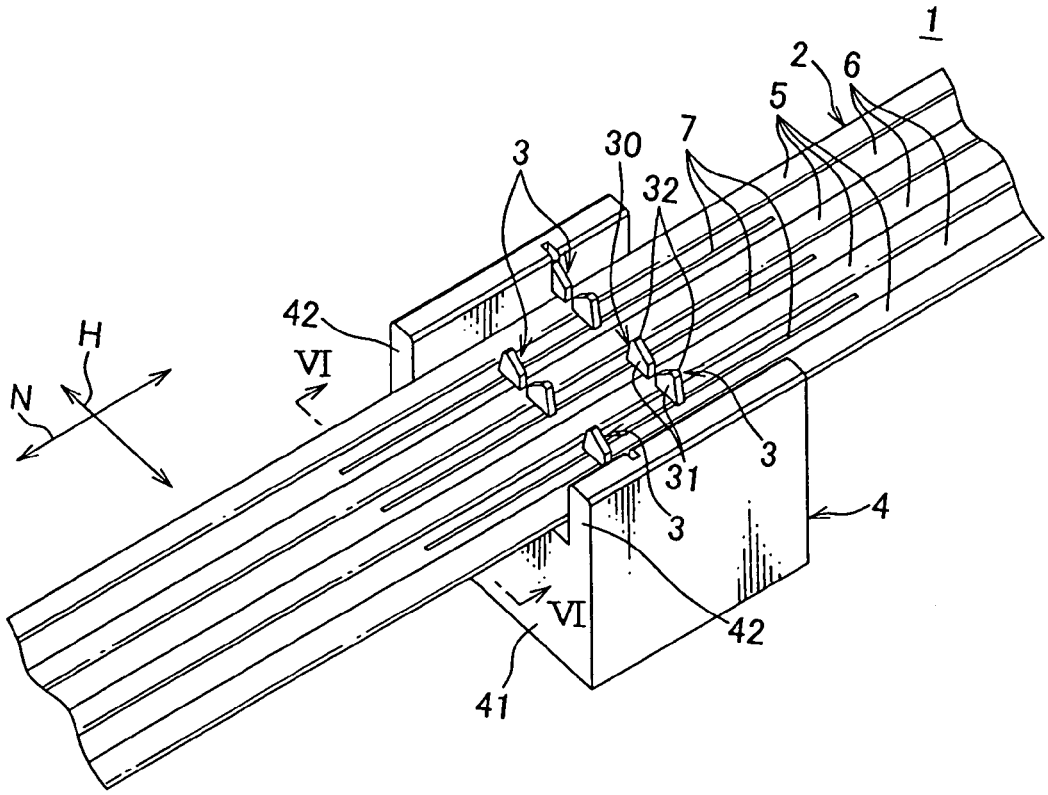
FIG. 1 is a perspective view of a wiring harness of an embodiment according to the present invention.
Figure 2:
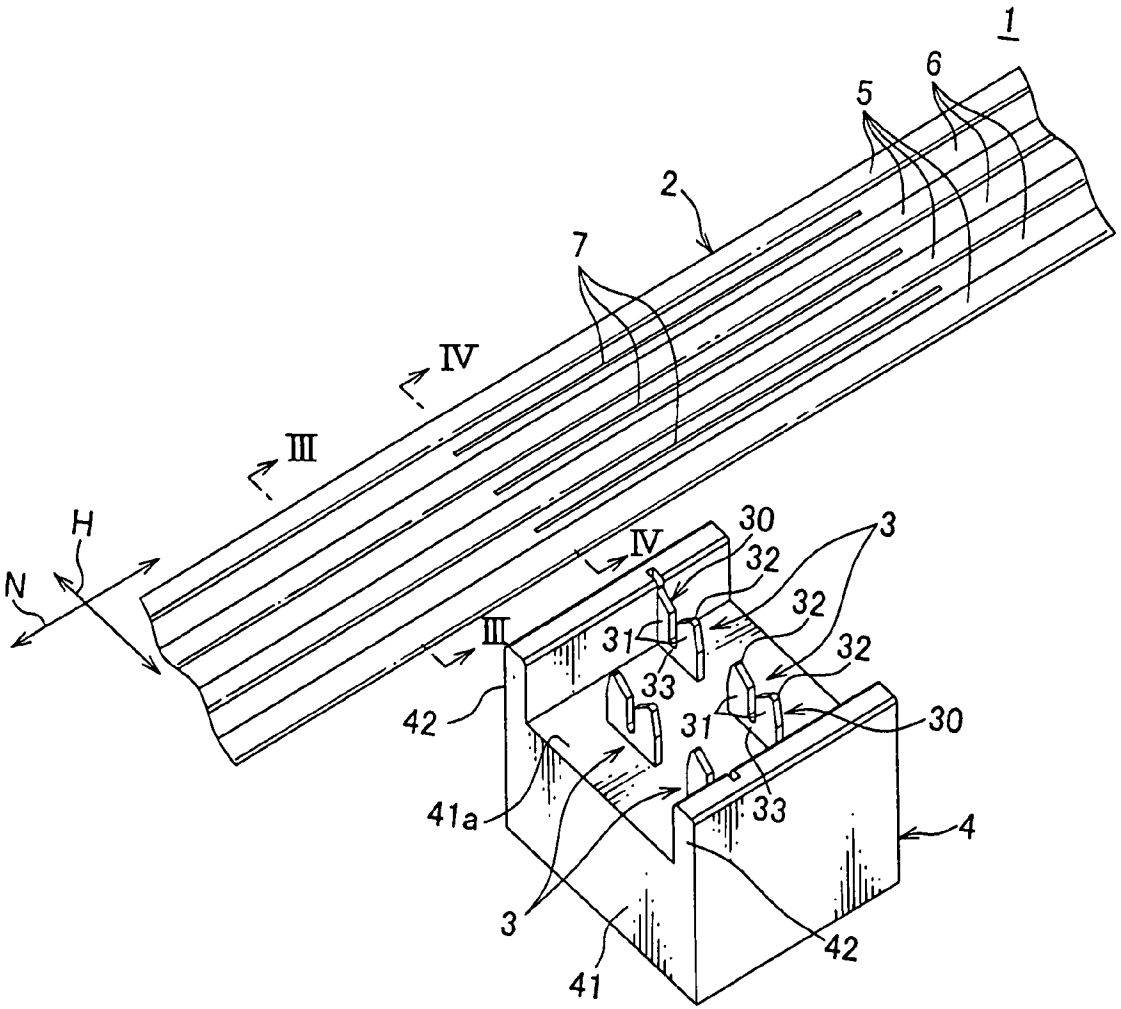
FIG. 2 is a perspective view of a flat cable and contact blades before the contact blade penetrating to the flat cable shown in FIG. 1.
Figure 3:
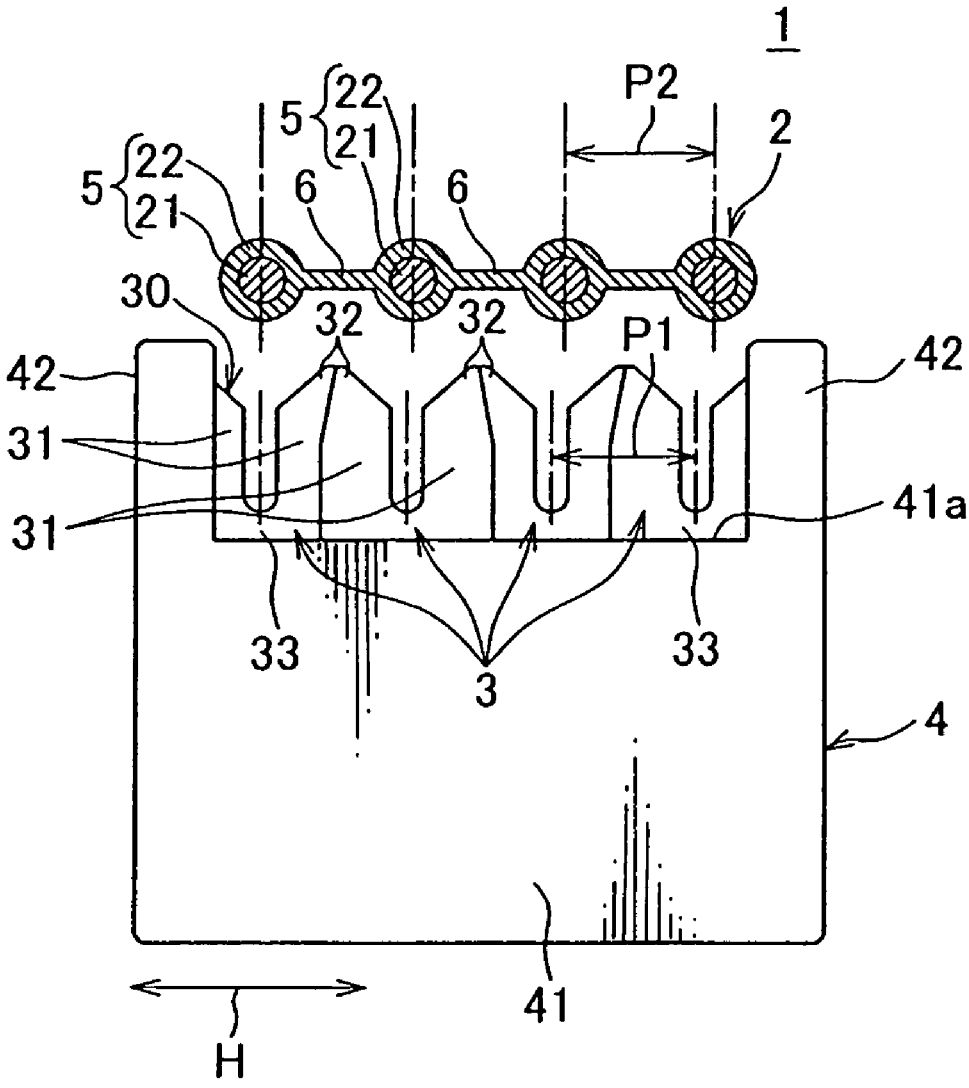
FIG. 3 is across-sectional view taken along the line III-III in FIG. 2.
Figure 4:
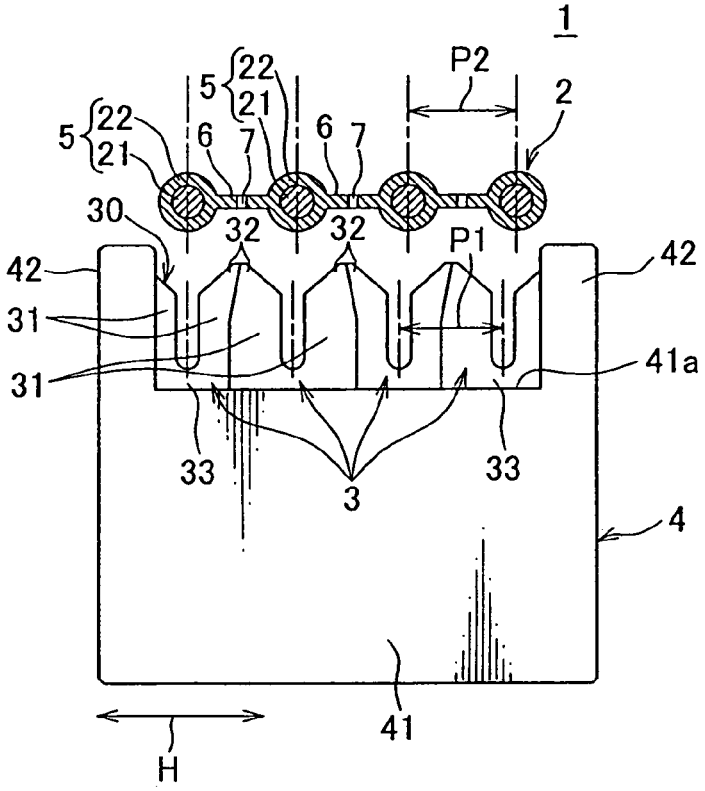
FIG. 4 is a cross-sectional view taken along the line IV-IV in FIG. 2.
Figure 5:
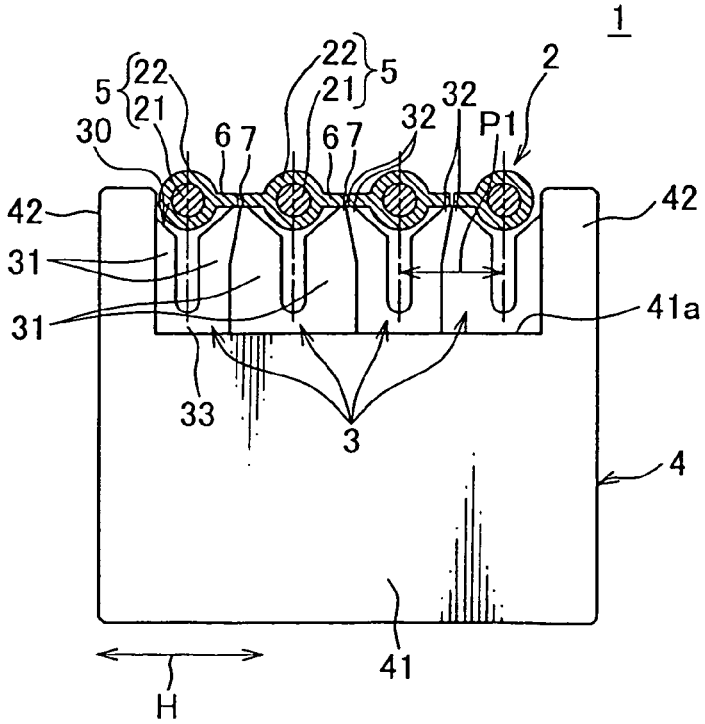
FIG. 5 is a cross-sectional view of the flat cable shown in FIG. 4 in a condition that a width of an interim portion of the flat cable is narrowed.
Figure 6:
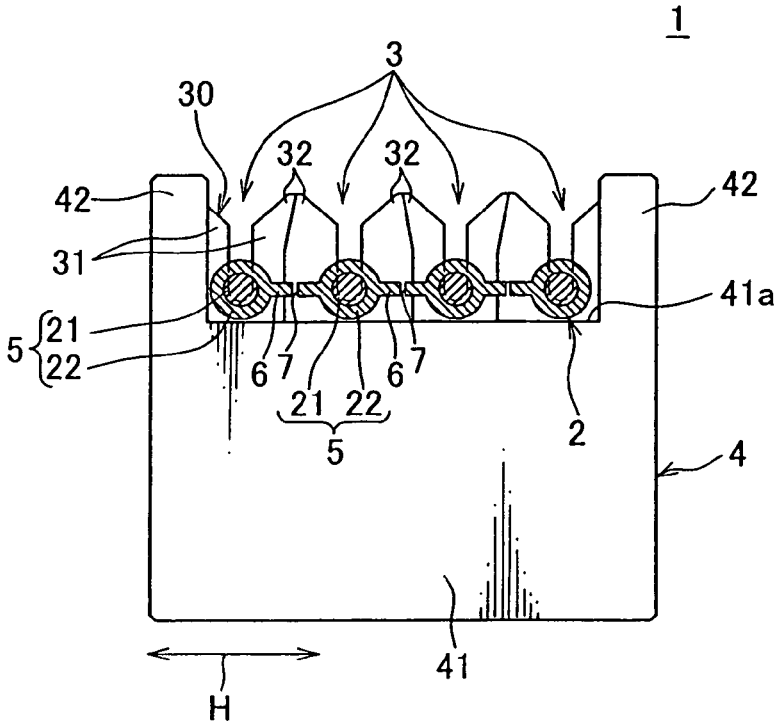
FIG. 6 is a cross-sectional view taken along the line VI-VI in FIG. 1.

A wiring harness of a first embodiment according to the present invention will be described with reference to FIGS. 1-6. FIG. 1 is a perspective view of a wiring harness of the first embodiment according to the present invention. FIG. 2 is a perspective view of a flat cable and contact blades before the contact blade penetrating to the flat cable shown in FIG. 1. FIG. 3 is a cross-sectional view taken along the line III-III in FIG. 2. FIG. 4 is a cross-sectional view taken along the line IV-IV in FIG. 2. FIG. 5 is a cross-sectional view of the flat cable shown in FIG. 4 in a condition that a width of an interim portion of the flat cable is narrowed. FIG. 6 is a cross-sectional view taken along the line VI-VI in FIG. 1.

The wiring harness 1 according to the present invention is wired at a car body of a car so as to supply electric power and transmit signals to an electronic device mounted in the car. The wiring harness 1, as shown in FIGS. 1, 2, includes a flat cable 2 and a plurality of pressure contact terminals 3 arranged at a housing 4 of a room lamp as the electronic device and connected to the flat cable 2 at an interim portion in a lengthwise direction of the flat cable 2. An arrow N in FIGS. 1-6 shows a lengthwise direction of the flat cable 2. An arrow H in FIGS. 1-6 shows a widthwise direction of the flat cable 2.

The flat cable 2, as shown in FIGS. 3, 4, includes a plurality of electric wires 5 arranged at even intervals in parallel to each other, and a joint 6 joining the electric wires 5 adjacent to each other. The electric wire 5 includes a conductive core wire 21 and a cover 22 covering the core wire 21. The joint 6 and the cover 22 are formed integrally with insulating synthetic resin. Such flat cable 2 is formed into a band shape to be flexible.

In the flat cable 2, each interval (shown with P2 in FIG. 3) of centers between the core wires 21 of the adjacent electric wires 5 is formed to be equal to each other. A slit 7 extending along the lengthwise direction of the flat cable 2 is provided at the interim portion of each joint 6. The slit 7 passes through the joint 6 along a direction of a thickness of the flat cable 2.

The plurality of pressure contact terminals 3 is formed by pressing a conductive metal sheet. The pressure contact terminal 3 includes a connecting portion (not shown) connected to a circuit of the room lamp, and a contact blade 30 projecting from a flat outer surface 41*a* of the housing 4 and penetrating the flat cable 2 so as to touch the core wire 21.

The contact blade 30 includes a pair of blade portions 31 having a gap to position the core wire 21 therebetween when penetrating to the interim portion, and a blade connecting portion 33 connecting both ends, near to the outer surface 41*a*, of the pair of blade portions 31. The each blade portion 31 includes a top end 32 formed with an acute angle to penetrate the interim portion through the slit 7 (shown in FIG. 5). The contact blade 30 is partially positioned in the slit 7 when penetrating to the interim portion as shown in FIGS. 1-6.

The plurality of contact blade 30 is arranged along the widthwise direction of the flat cable 2 so as to be controlled not to be changed about an interval of adjacent contact blades 30 along the widthwise direction of the flat cable 2. Thus, the plurality of contact blades 30 is fixed at the housing 4.

The adjacent contact blades 30 along the widthwise direction of the flat cable 2 are arranged alternately in the lengthwise direction of the flat cable 2 so as to make an interval between centers of the adjacent contact blades 30 (shown with P1 in FIG. 3) smaller than a width of the contact blade 30. In other words, the adjacent contact blades 30 along the widthwise direction are arranged so as to overlap the blade portions 31 to each other. The plurality of contact blades 30 is arranged so as to make the interval between the centers of the adjacent contact blades 30 (shown with P1 in FIG. 3) even to each interval.

The flat cable 2 before connecting with the contact blades 3 has an interval between centers of the core wires 21 of the adjacent electric wires 5, that is a wire interval P2, larger than the interval between the centers of the adjacent contact blades 30 of the plurality of pressure contact terminals 3, that is a terminal interval P1, as shown in FIGS. 3, 4.

The housing 4 is made of insulating synthetic resin, and includes a rectangular-shape main body 41 and a pair of vertical walls 42 projecting vertically from a top surface, that is the outer surface 41*a* of the main body 41. The pair of vertical walls 42 project from both ends in the direction along the arrow H of the main body 41 and extends in the direction along the arrow N. The flat cable 2, to which the plurality of pressure contact terminals 3 penetrates, is positioned at the interim portion on the outer surface 41*a* between the pair of vertical walls 42.

When each of the pressure contact terminals 3 is connected with the interim portion of each of the plurality of electric wires 5 of the flat cable 2, the adjacent interim portions of the plurality of electric wires 5 are deformed by narrowing a width of each of the slits 7 so as to position the center of each core wire 21 on the center of each contact blade 30.

Thereafter, each contact blade 30 is moved close to the flat cable 2 so as to penetrate to the interim portion. In this process, first, the top end 32 of the contact blade 30 passes through the slit 7. Next, according to the flat cable 2 nearing to the outer surface 41*a*, the blade connecting portion 33 cuts into the joint 6 and the cover 22 and reaches the core wire 21.

Each of inner edges of the pair of blades 31 of the contact blades 30 touches the core wire 21, and each contact blade 30 and the core wire 21 of each electric wire 5 are electrically connected to each other. FIG. 6 shows a condition that the electric wire 5 is positioned corresponding to the contact blade 30 to be electrically connected thereto, and the wire interval at the interim portion of the flat cable 2 is adjusted equal to the terminal interval and the core wire 21 of each electric wire is positioned between the pair of blades 31 so as to touch the pair of blades 31.

According to the present invention, the slit 7 is provided at joint 6 of the flat cable 2 at the interim portion, and the interim portions of the plurality of electric wires 5 are made close to each other by narrowing the width of the slit 7 so as to be positioned to be electrically connected with the contact blade 30. Thereby, the flat cable 2 having the wire interval different from the terminal interval of the contact blades 30 can be connected to the contact blades 30.

The contact blade 30 includes the top end 32 formed with an acute angle to pass through the slit 7 when penetrating to the interim portion. Thereby, a large force for the contact blade 30 penetrating to the flat cable 2 is not required. When the miniaturized contact blade 30 penetrates to the flat cable 2, it can be prevented that the contact blade 30 is bent and/or displaced from the electric wire 5.

Since the adjacent contact blades 30 along the widthwise direction of the flat cable 2 are arranged alternately in the lengthwise direction of the flat cable 2 so as to make the interval P1 between centers of the adjacent contact blades 30 smaller than a width of the contact blade 30, the interval P1 between the centers of the adjacent contact blades 30, that is a terminal interval P1, can be smaller.

According to the present invention, the wiring harness 1 having the flat cable 2 with adjustable wire interval, which can be connected with the plurality of pressure contact terminals 3 with a smaller terminal interval corresponding to a miniaturized electronic device, can be provided.

Figure 7:
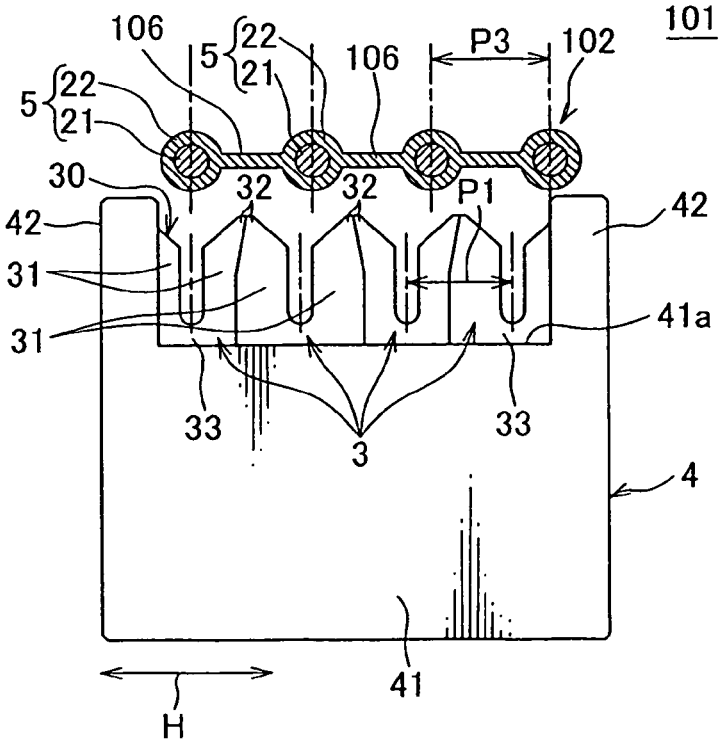
FIG. 7 is a cross-sectional view at an end area of a flat cable of a wiring harness of a second embodiment according to the present invention.
Figure 8:
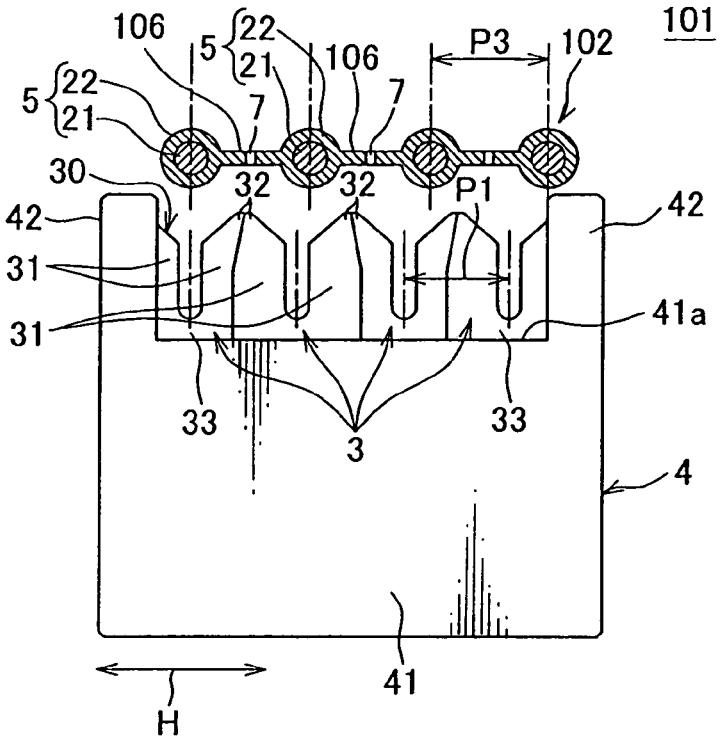
FIG. 8 is a cross-sectional view of an interim portion of the flat cable shown in FIG. 7.
Figure 9:
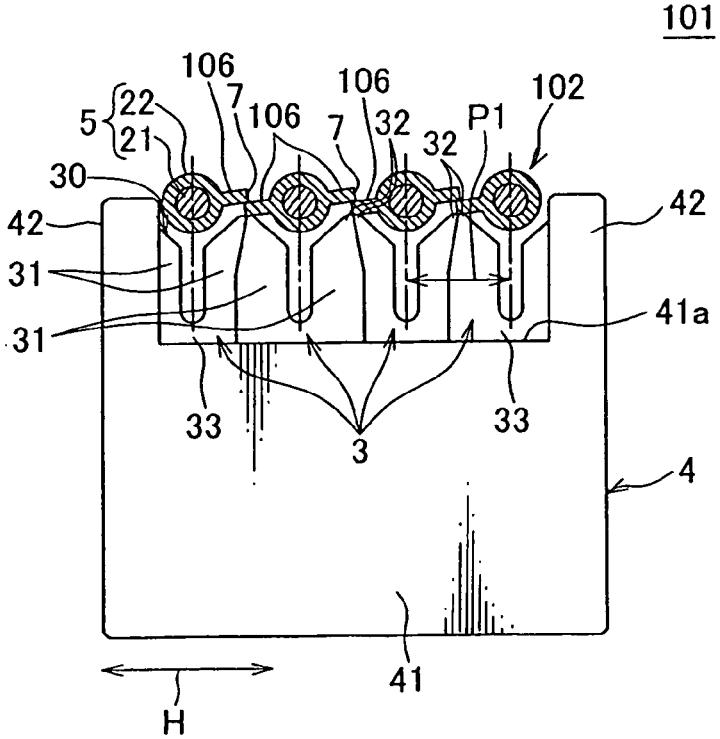
FIG. 9 is a cross-sectional view of the flat cable shown in FIG. 8 in a condition that a width of an interim portion of the flat cable is narrowed.
Figure 10:
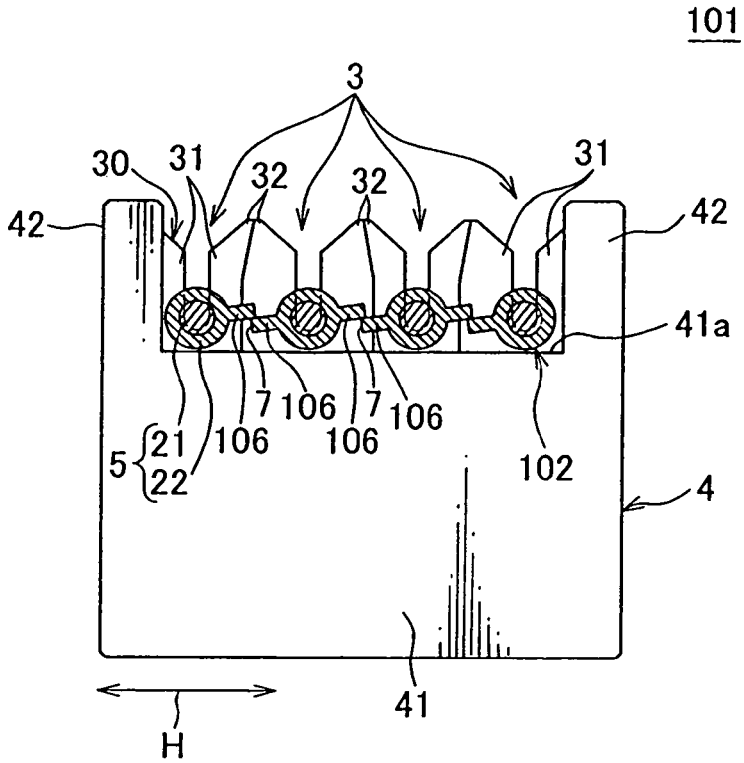
FIG. 10 is a cross-sectional view of the flat cable shown in FIG. 9 in a condition that a contact blade penetrates to the interim portion of the flat cable.
Figure 11:
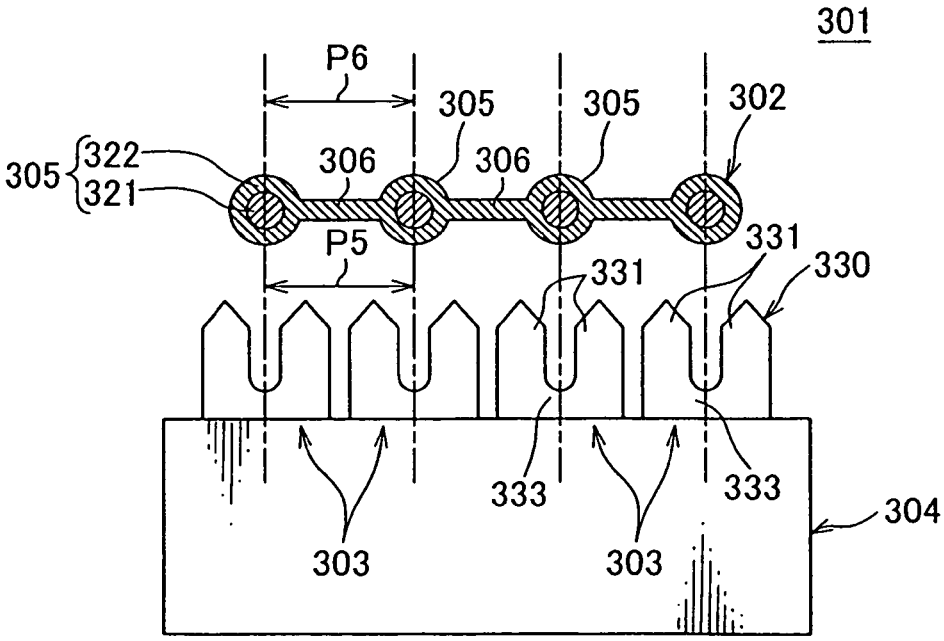
FIG. 11 PRIOR ART
FIG. 11 is a cross-sectional view of a flat cable of a wiring harness by prior art in a condition before a contact blade penetrating to the flat cable.
Figure 12:
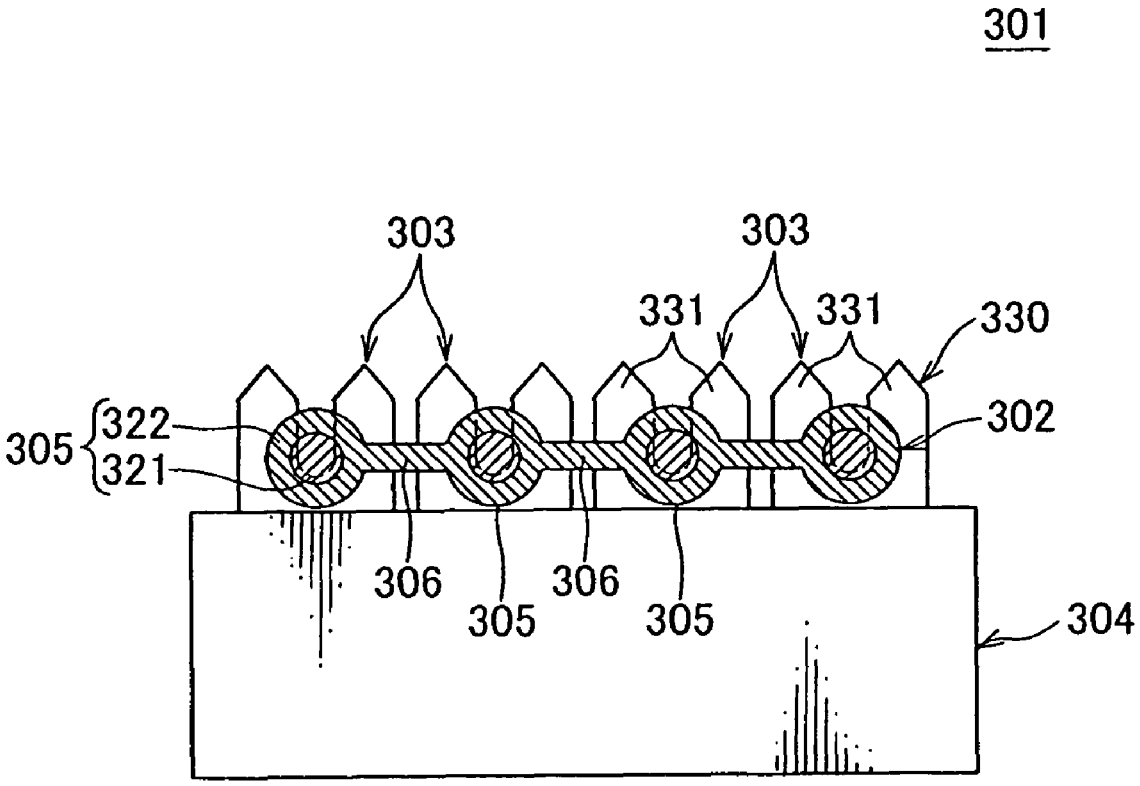
FIG. 12 PRIOR ART
FIG. 12 is a cross-sectional view of the flat cable shown in FIG. 11 in a condition of the contact blade penetrating to the flat cable.

A wiring harness of a second embodiment according to the present invention will be described with reference to FIGS. 7-10. FIG. 7 is a cross-sectional view at an end area of a flat cable of a wiring harness of the second embodiment according to the present invention. FIG. 8 is a cross-sectional view of an interim portion of the flat cable shown in FIG. 7. FIG. 9 is a cross-sectional view of the flat cable shown in FIG. 8 in a condition that a width of an interim portion of the flat cable is narrowed. FIG. 10 is a cross-sectional view of the flat cable shown in FIG. 9 in a condition that a contact blade penetrates to the interim portion of the flat cable. In FIGS. 7-10, the same components as that of the first embodiment are putted with the same marking and the description about that is omitted.

The wiring harness 101 according to the second embodiment, as shown in FIGS. 7-10, includes a flat cable 101 and a plurality of pressure contact terminals 3 connected to an interim portion in a lengthwise direction of the flat cable 102.

The flat cable 102 includes a plurality of electric wires 5 arranged at even intervals in parallel to each other, and a joint 106 joining the electric wires 5 adjacent to each other. A slit 7 extending along the lengthwise direction of the flat cable 102 is provided at the interim portion of each joint 106 (shown in FIG. 8). Each interval between the centers of the core wires 21 of the adjacent electric wires 5 (as P3 shown in FIG. 7) of the flat cable 102 is formed at even. The interval between the centers of the core wires 21 of the adjacent electric wires 5 of the flat cable 102, that is a wire interval P3, is formed larger than the terminal interval P1 of the plurality of pressure contact terminals 3 and the wire interval P2 of the flat cable 2 according to the first embodiment.

When each of the pressure contact terminals 3 is connected with the interim portion of each of the plurality of electric wires 5 of the flat cable 102, the adjacent interim portions of the plurality of electric wires 5 are deformed by narrowing a width of each of the slits 7 and slanting the interim portion against the direction of the arrow H so as to position the center of each core wire 21 on the center of each contact blade 30.

Thereafter, by moving the flat cable 102 close to the plurality of contact blades 30, each contact blade 30 penetrates to the interim portion. Thereby, as shown in FIG. 10, inner edges of the pair of blades 31 of the contact blade 30 touch to the core wire 21 so as to connect electrically each contact blade 30 and the core wire 21 of each electric wire 5.

As mentioned above, according to the embodiment, the adjacent interim portions of the plurality of electric wires 5 are deformed by narrowing a width of each of the slits 7 and slanting the interim portion against the direction of the arrow H. Thereby, the width of the interim portion of the flat cable 102, that is the wire interval, can be narrowed more than that of the first embodiment.

According to the first and second embodiments, the plurality of pressure contact terminals 3 is arranged at the housing 4 of the room lamp as the electronic device. According to the present invention, the plurality of pressure contact terminals 3 can be arranged at a housing of a connector.

According to the first and second embodiments, the wiring harness 1, 101 includes pressure contact terminals 3 having a contact blade 30. According to the present invention, the wiring harness can include a bus bar having the contact blade 30 instead of the pressure contact terminals 3.

While, in the embodiment, the present invention is described, it is not limited thereto. Various change and modifications can be made with the scope of the present invention.

The invention claimed is:

1. A wiring harness comprising:

a flat cable having a plurality of electric wires and joints joining said electric wires adjacent to each other; and a plurality of contact blades arranged along a widthwise direction of the flat cable so as to control a terminal interval along the widthwise direction of the flat cable to be maintained, and penetrating to the flat cable at an interim portion in a lengthwise direction of the flat cable so as to touch a core wire of each of the electric wires, wherein a slit is arranged at each of the joints at the interim portion of the flat cable, wherein the plurality of electric wires is arranged closer to each other by narrowing a width of the slit so as to be positioned corresponding to each of said contact blades to be electrically connected thereto.

2. The wiring harness according to claim 1, wherein a portion of the each of the contact blades is provided in the slit.

3. The wiring harness according to claim 2, wherein each of the contact blades comprises a top end formed with an acute angle to penetrate the interim portion through the slit.

4. The wiring harness according to claim 3, wherein the contact blades adjacent each other along the widthwise direction of the flat cable are arranged alternately in the lengthwise direction of the flat cable so as to make an interval between centers of the contact blades adjacent to each other smaller than a width of each of the contact blades.

5. The wiring harness according to claim 2, wherein the contact blades adjacent to each other along the widthwise direction of the flat cable are arranged alternately in the lengthwise direction of the flat cable so as to make an interval between centers of the contact blades adjacent to each other smaller than a width of each of the contact blades.

6. The wiring harness according to claim 1, wherein each of the contact blades comprises a top end formed with an acute angle to penetrate the interim portion through the slit.

7. The wiring harness according to claim 6, wherein the contact blades adjacent to each other along the widthwise direction of the flat cable are arranged alternately in the lengthwise direction of the flat cable so as to make an interval between centers of the contact blades adjacent to each other smaller than a width of each of the contact blades.

8. The wiring harness according to claim 1 wherein the contact blades adjacent each other along the widthwise direction of the flat cable are arranged alternately in the lengthwise direction of the flat cable so as to make an interval between centers of the contact blades adjacent to each other smaller than a width of each of the contact blades.

* * * * *